US008956194B2

(12) United States Patent
Xie et al.

(10) Patent No.: US 8,956,194 B2
(45) Date of Patent: Feb. 17, 2015

(54) BATTERY CONNECTOR AND ELECTRICAL TERMINAL THEREOF

(71) Applicant: Cheng Uei Precision Industry Co., Ltd., New Taipei (TW)

(72) Inventors: Bao-Geng Xie, Dong-Guan (CN); Wei-Hong Liao, Dong-Guan (CN); Yin-Lung Wu, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 108 days.

(21) Appl. No.: 13/889,342

(22) Filed: May 7, 2013

(65) Prior Publication Data

US 2014/0335737 A1 Nov. 13, 2014

(51) Int. Cl.
*H01R 24/00* (2011.01)
*H01R 13/05* (2006.01)
*H01R 13/516* (2006.01)

(52) U.S. Cl.
CPC ..... *H01R 13/05* (2013.01); *H01R 13/516* (2013.01)
USPC ..... 439/862; 439/660

(58) Field of Classification Search
USPC ..... 439/660, 862
See application file for complete search history.

(56) References Cited

U.S. PATENT DOCUMENTS

| | | | | |
|---|---|---|---|---|
| 5,092,783 | A * | 3/1992 | Suarez et al. | 439/71 |
| 6,994,566 | B2 * | 2/2006 | You | 439/66 |
| 7,296,347 | B2 * | 11/2007 | Antaya et al. | 29/874 |
| 7,727,033 | B2 * | 6/2010 | Tsuji | 439/862 |
| 8,079,876 | B2 * | 12/2011 | Wang et al. | 439/630 |
| 8,206,188 | B1 * | 6/2012 | Zhang et al. | 439/862 |
| 8,715,019 | B2 * | 5/2014 | Ho | 439/862 |
| 2002/0034895 | A1 * | 3/2002 | Morita | 439/660 |
| 2005/0130510 | A1 * | 6/2005 | Zheng et al. | 439/862 |
| 2007/0117473 | A1 * | 5/2007 | Uchida et al. | 439/862 |
| 2007/0224890 | A1 * | 9/2007 | Chien et al. | 439/862 |
| 2011/0104909 | A1 * | 5/2011 | Zhu | 439/55 |
| 2012/0171909 | A1 * | 7/2012 | Harada | 439/862 |

* cited by examiner

*Primary Examiner* — Gary Paumen
(74) *Attorney, Agent, or Firm* — Cheng-Ju Chiang

(57) ABSTRACT

A battery connector includes an insulating body and a plurality of electrical terminals. The insulating body defines a plurality of terminal grooves for receiving the electrical terminals therein. The electrical terminals each has a substantially U-shaped supporting portion which has a fastening portion levelly extending in the bottom and an elastic portion curved upward and then extending frontward from a rear end of the fastening portion. A front end of the fastening portion is bent downward and then extends frontward to form a soldering tail. A front end of the elastic portion is bent downward and extends frontward to form a pre-pressing portion extending frontward beyond a front end of the soldering tail in vertical direction. A front end of the pre-pressing portion slantwise extends upward and then is curved downward to form a contact portion projecting in front of the soldering tail.

8 Claims, 4 Drawing Sheets

BATTERY CONNECTOR AND ELECTRICAL TERMINAL THEREOF

BACKGROUND OF THE INVENTION

1. Field of the Invention

The present invention relates to a connector, and more particularly to a battery connector and electrical terminals thereof.

2. The Related Art

Electronic appliances are widely used more and more with the development of electronic technology. The electronic appliances usually utilize rechargeable batteries as power sources. Accordingly, a battery connector adapted to connecting the rechargeable batteries to the electronic appliances is used widely.

Referring to FIG. 4, a traditional battery connector includes an insulating body (not shown) and a plurality of electrical terminals 20' disposed in the insulating body. Each of the electrical terminals 20' has a U-shaped supporting portion 21', a soldering portion 23' and a contact portion 22' which are connected with two ends of the supporting portion 21', wherein the contact portion 22' is located over the soldering portion 23'. A free end of the contact portion 22' further extends to form a pre-pressing portion 24' located over the soldering portion 23'. In use, the rechargeable battery is inserted in the battery connector and electrically contacts with the contact portions 22' of the electrical terminals 20'. However, the pre-pressing portions 24' and the contact portions 22' easily hit against the soldering portions 23' when external force is acted on the contact portions 22', so that often causes the electrical terminals 20' to deform and even lose elasticity permanently.

SUMMARY OF THE INVENTION

Accordingly, an object of the present invention is to provide a battery connector. The battery connector includes an insulating body and a plurality of electrical terminals. The insulating body defines a plurality of terminal grooves therein. A front end of a bottom wall of each terminal groove is concaved rearward to form a receiving cavity. The electrical terminals each has a substantially U-shaped supporting portion which has a fastening portion levelly extending in the bottom and an elastic portion curved upward and then extending frontward from a rear end of the fastening portion. A front end of the fastening portion is bent downward and then extends frontward to form a soldering tail. A front end of the elastic portion is bent downward and extends frontward to form a pre-pressing portion. A front end of the pre-pressing portion slantwise extends upward and then is curved downward to form a contact portion projecting in front of the soldering tail in vertical direction. The electrical terminals are received in the terminal grooves of the insulating body. The fastening portion of the supporting portion of the electrical terminal is fastened against the bottom wall of the terminal groove. The soldering tail is located in the receiving cavity. The elastic portion and the contact portion are received in the terminal groove with the contact portion projecting beyond a top face of the insulating body. The pre-pressing portion extends frontward beyond a front end of the soldering tail to avoid hitting against the soldering tail when an external force is acted on the contact portion. The pre-pressing portion is further movably restrained in the terminal groove to avoid the contact portion excessively rebounding upward.

Accordingly, another object of the present invention is to provide an electrical terminal. The electrical terminal has a substantially U-shaped supporting portion which has a fastening portion levelly extending in the bottom and an elastic portion curved upward and then extending frontward from a rear end of the fastening portion, a soldering tail bent downward and then extending frontward from a front end of the fastening portion, a pre-pressing portion bent downward and extending frontward from a front end of the elastic portion, and a contact portion slantwise extending upward and then curved downward from a front end of the pre-pressing portion to project in front of the soldering tail in vertical direction. The pre-pressing portion extends frontward beyond a front end of the soldering tail to avoid hitting against the soldering tail when an external force is acted on the contact portion.

As described above, the pre-pressing portion is connected between the contact portion and the elastic portion of the electrical terminal to make the contact portion project in front of the soldering tail, and furthermore, the pre-pressing portion also extends frontward beyond the front end of the soldering tail in vertical direction, so that can effectively avoid the contact portion and the pre-pressing portion hitting against the soldering tail when an external force is acted on the contact portion.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
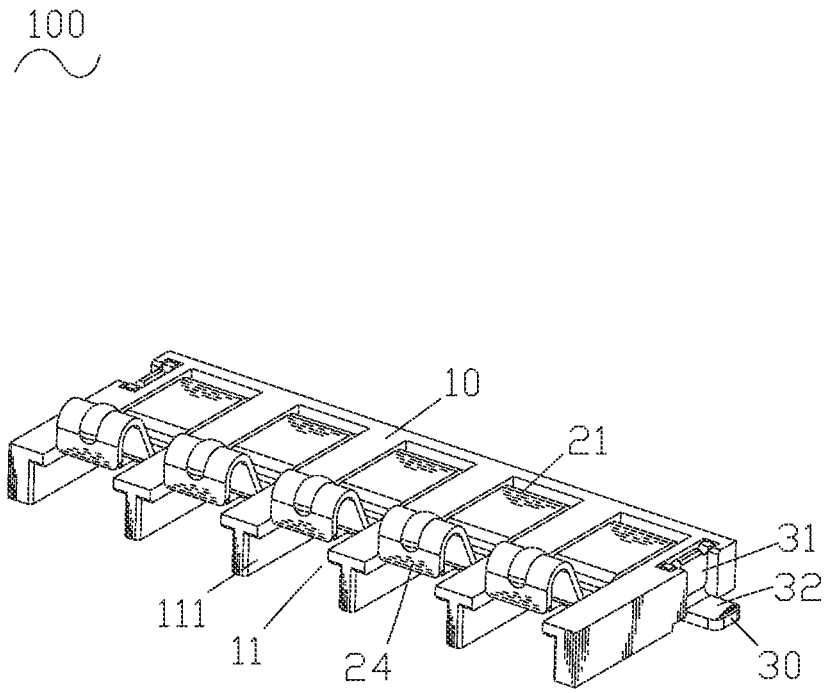
FIG. 1 is an assembled, perspective view of a battery connector in accordance with an embodiment of the present invention.
Figure 2:
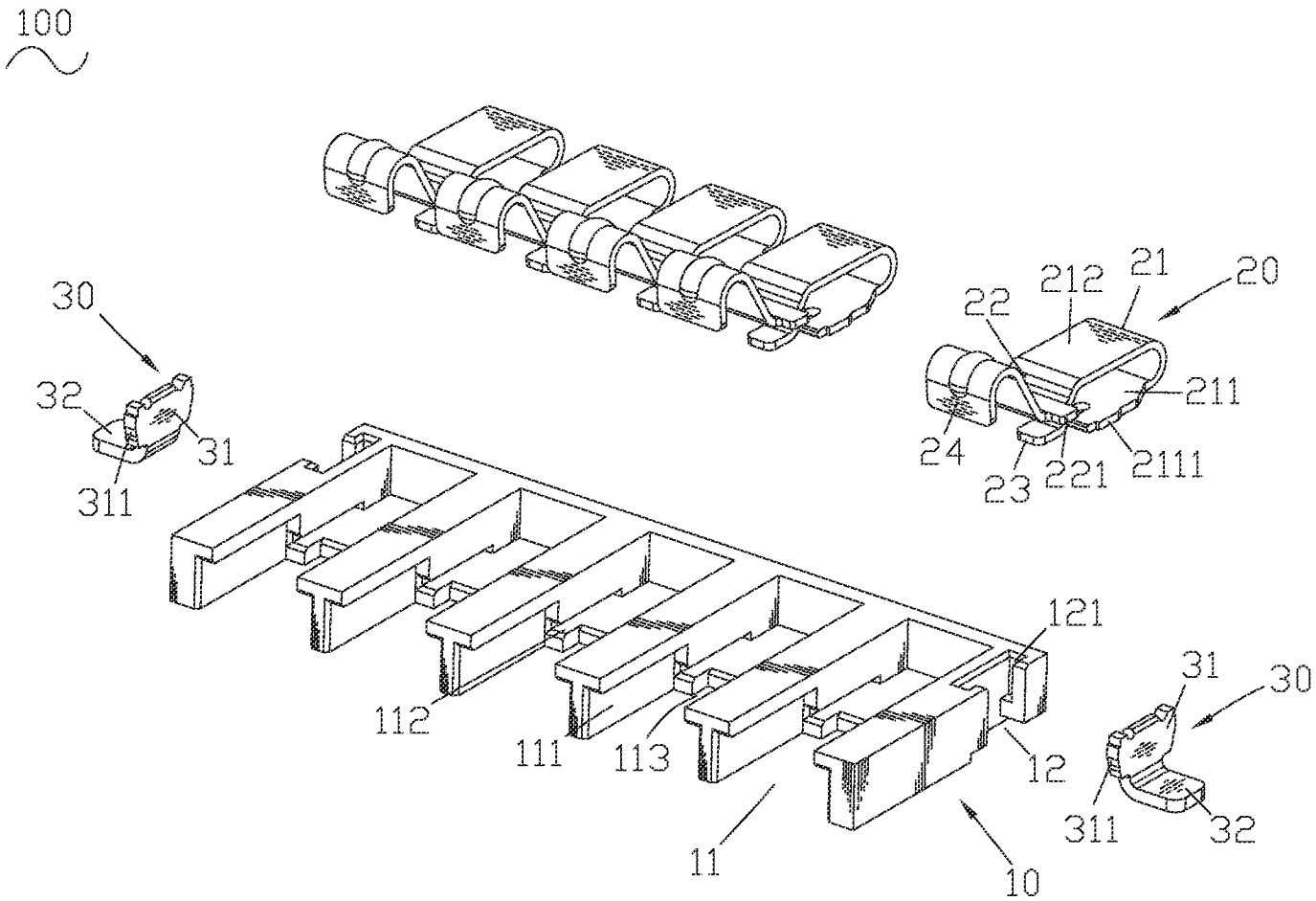
FIG. 2 is an exploded, perspective view of the battery connector shown in FIG. 1.

Referring to the drawings in greater detail, and first to FIGS. 1 and 2, an embodiment of the present invention is embodied in a battery connector 100. The battery connector 100 includes an insulating body 10, a plurality of electrical terminals 20 and a plurality of fastening terminals 30.

Figure 3:
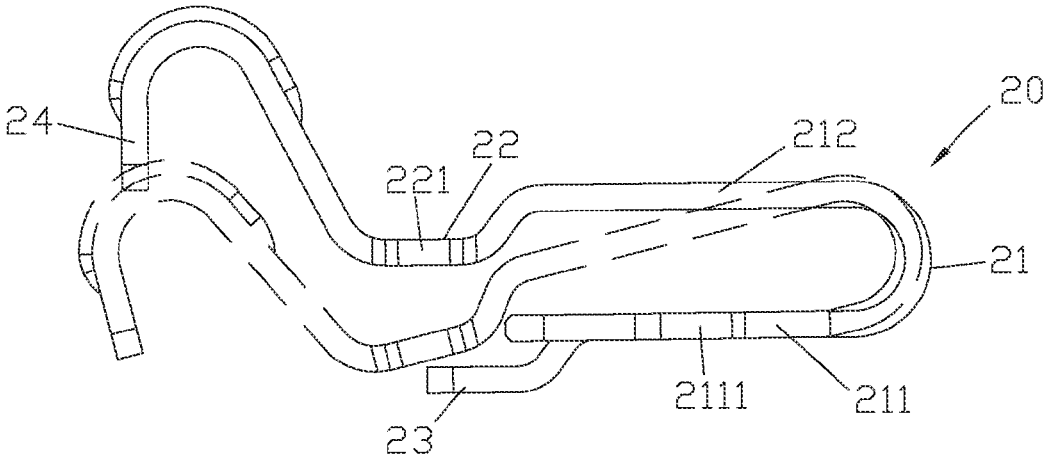
FIG. 3 is a cross-sectional view of an electrical terminal of the battery connector shown in FIG. 1.
Figure 4:
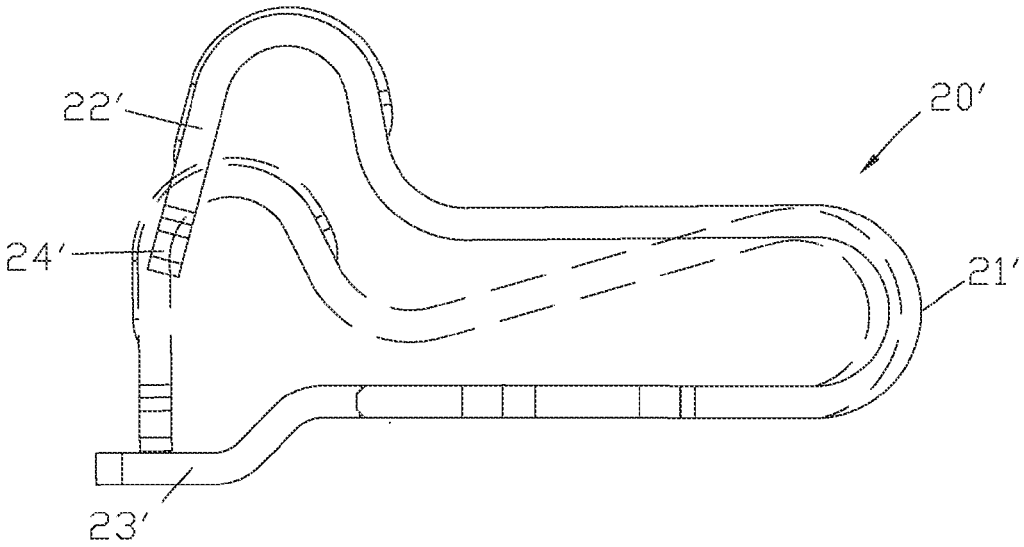
FIG. 4 (Prior Art)
FIG. 4 is a cross-sectional view of an electrical terminal of a conventional battery connector.

With reference to FIGS. 2 and 3, the insulating body 10 is a substantially rectangular body. The insulating body 10 defines a plurality of terminal grooves 11 each penetrating through a front face, a top face and a bottom face thereof. Two inner sidewalls of a front of each terminal groove 11 are oppositely extended to form a pair of expansion slots 111. Two insides of two opposite sidewalls of each terminal groove 11 adjacent to a bottom wall of the terminal groove 11 are oppositely concaved to form a pair of slide slots 112. A front end of the bottom wall of each terminal groove 11 is concaved rearward to form a receiving cavity 113. Two opposite sides of a rear of the insulating body 10 are concaved inward to form a pair of fastening grooves 12. Two opposite sides of each fastening groove 12 are oppositely concaved to form a pair of fastening slots 121.

Each of the electrical terminals 20 has a substantially U-shaped supporting portion 21 which has a fastening portion 211 levelly extending in the bottom and an elastic portion 212 curved upward and then extending frontward from a rear end of the fastening portion 211, a soldering tail 23 bent downward and then extending frontward from a front end of the fastening portion 211, a pre-pressing portion 22 bent downward and extending frontward from a front end of the elastic portion 212, and a contact portion 24 slantwise extending upward and then curved downward from a front end of the pre-pressing portion 22. The pre-pressing portion 22 extends frontward beyond a front end of the soldering tail 23 to make the contact portion 24 project in front of the soldering tail 23 in vertical direction. Two opposite side edges of the fastening portion 211 oppositely protrude outward to form a pair of fastening ears 2111. Two opposite side edges of a level part of the pre-pressing portion 22 oppositely protrude outward to form a pair of restraining ears 221.

Each of the fastening terminals 30 shows a substantial L-shape and has a base portion 31 and a soldering portion 32. Two opposite side edges of the base portion 31 oppositely protrude outward to form a pair of fastening lumps 311.

Referring to FIGS. 1 and 2, in assembly, the electrical terminals 20 are received in the terminal grooves 11 of the insulating body 10. The fastening ears 2111 of the fastening portion 211 slide along the slide slots 112 of the terminal groove 11 and are fastened in the slide slots 112, to make the fastening portion 211 of the supporting portion 21 be fastened against the bottom wall of the terminal groove 11. The soldering tail 23 is located in the receiving cavity 113. The elastic portion 212 and the contact portion 24 are received in the terminal groove 11 with the contact portion 24 projecting beyond the top face of the insulating body 10. The pre-pressing portion 22 extends frontward beyond the front end of the soldering tail 23 and the contact portion 24 also projects in front of the soldering tail 23 in vertical direction, so as to avoid hitting against the soldering tail 23 when an external force is acted on the contact portion 24. The restraining ears 221 of the pre-pressing portion 22 are movable located in the expansion slots 111 and further restrained under top walls of the expansion slots 111, so as to make the pre-pressing portion 22 movable in the terminal groove 11 and further avoid the contact portion 24 excessively rebounding upward.

Then, the base portions 31 of the fastening terminals 30 are inserted downward into the fastening grooves 12 of the insulating body 10. The fastening lumps 311 of the base portions 31 are fastened in the fastening slots 121 of the fastening grooves 12. The soldering portions 32 of the fastening terminals 30 project outside the insulating body 10.

As described above, the pre-pressing portion 22 is connected between the contact portion 24 and the elastic portion 212 of the electrical terminal 20 to make the contact portion 24 project in front of the soldering tail 23, and furthermore, the pre-pressing portion 22 also extends frontward beyond the front end of the soldering tail 23 in vertical direction, so that can effectively avoid the contact portion 24 and the pre-pressing portion 22 hitting against the soldering tail 23 when an external force is acted on the contact portion 24.

What is claimed is:

1. A battery connector, comprising:

an insulating body defining a plurality of terminal grooves therein, a front end of a bottom wall of each terminal groove being concaved rearward to form a receiving cavity; and a plurality of electrical terminals received in the terminal grooves of the insulating body, each electrical terminal having a substantially U-shaped supporting portion which has a fastening portion levelly extending in the bottom and an elastic portion curved upward and then extending frontward from a rear end of the fastening portion, a front end of the fastening portion being bent downward and then extending frontward to form a soldering tail, a front end of the elastic portion being bent downward and extending frontward to form a pre-pressing portion, a front end of the pre-pressing portion slantwise extending upward and then being curved downward to form a contact portion projecting in front of the soldering tail in vertical direction;

wherein the fastening portion of the supporting portion of the electrical terminal is fastened against the bottom wall of the terminal groove, the soldering tail is located in the receiving cavity, the elastic portion and the contact portion are received in the terminal groove with the contact portion projecting beyond a top face of the insulating body, the pre-pressing portion extends frontward beyond a front end of the soldering tail, the pre-pressing portion is further movably restrained in the terminal groove.

2. The battery connector as claimed in claim 1, wherein two insides of two opposite sidewalls of each terminal groove adjacent to the bottom wall are oppositely concaved to form a pair of slide slots, two opposite side edges of the fastening portion oppositely protrude outward to form a pair of fastening ears, the fastening ears of the fastening portion slide along the slide slots of the terminal groove and are fastened in the slide slots.

3. The battery connector as claimed in claim 1, wherein two inner sidewalls of a front of each terminal groove are oppositely extended to form a pair of expansion slots, two opposite side edges of a level part of the pre-pressing portion oppositely protrude outward to form a pair of restraining ears, the restraining ears are movable located in the expansion slots and further restrained under top walls of the expansion slots.

4. The battery connector as claimed in claim 1, further comprising a plurality of fastening terminals of which each shows a substantial L-shape and has a base portion and a soldering portion, two opposite sides of a rear of the insulating body being concaved inward to form a pair of fastening grooves, the base portions of the fastening terminals being inserted downward into the fastening grooves, the soldering portions of the fastening terminals projecting outside the insulating body.

5. The battery connector as claimed in claim 4, wherein two opposite side edges of the base portion oppositely protrude outward to form a pair of fastening lumps, two opposite sides of each fastening groove are oppositely concaved to form a pair of fastening slots, the fastening lumps of the base portions are fastened in the fastening slots of the fastening grooves.

6. An electrical terminal, comprising:

a substantially U-shaped supporting portion which has a fastening portion levelly extending in the bottom and an elastic portion curved upward and then extending frontward from a rear end of the fastening portion;

a soldering tail bent downward and then extending frontward from a front end of the fastening portion;

a pre-pressing portion bent downward and extending frontward from a front end of the elastic portion; and a contact portion slantwise extending upward and then curved downward from a front end of the pre-pressing portion to project in front of the soldering tail in vertical direction;

wherein the pre-pressing portion extends frontward beyond a front end of the soldering tail.

7. The electrical terminal as claimed in claim 6, wherein two opposite side edges of the fastening portion oppositely protrude outward to form a pair of fastening ears.

8. The electrical terminal as claimed in claim 6, wherein two opposite side edges of a level part of the pre-pressing portion oppositely protrude outward to form a pair of restraining ears.

* * * * *